US007686664B2

(12) United States Patent
Kalyanasundaram et al.

(10) Patent No.: US 7,686,664 B2
(45) Date of Patent: Mar. 30, 2010

(54) METHOD OF MANUFACTURING CUSTOMIZED ELECTROLUMINESCENT DISPLAY

(75) Inventors: Krishna Kalyanasundaram, Elmhurst, IL (US); Daniel R. Gamota, Palatine, IL (US); Krishna D. Jonnalagadda, Algonquin, IL (US)

(73) Assignee: Motorola, Inc., Schaumburg, IL (US)

( * ) Notice: Subject to any disclaimer, the term of this patent is extended or adjusted under 35 U.S.C. 154(b) by 1089 days.

(21) Appl. No.: 11/275,374

(22) Filed: Dec. 29, 2005

(65) Prior Publication Data

US 2007/0164658 A1 Jul. 19, 2007

(51) Int. Cl.
*H01J 9/24* (2006.01)

(52) U.S. Cl. ..... 445/24; 313/506; 313/509

(58) Field of Classification Search ..... 445/24–25; 313/498–512

See application file for complete search history.

(56) References Cited

U.S. PATENT DOCUMENTS 5,565,733 A 10/1996 Krafcik et al.
2003/0063052 A1 4/2003 Rebh
2004/0195576 A1* 10/2004 Watanabe et al. ..... 257/79

FOREIGN PATENT DOCUMENTS

JP 08148283 A 7/1996
JP 10228255 A 8/1998

OTHER PUBLICATIONS

Joseph L. Williams, "Restriction/Election Requirement issued in related U.S. Appl. No. 11/275,373," USPTO, Apr. 6, 2009, 8 pages.
John T. Bretscher, "Response to Restriction/Election Requirement issued in related U.S. Appl. No. 11/275,373," Motorola, Inc., Apr. 6, 2009, 5 pages.
Blaine R. Copenheaver, "PCT International Search Report and Written Opinion," WIPO, ISA/US, Commissioner for Patents, Alexandria, VA, USA, Apr. 1, 2008.
Philippe Becamel, "PCT International Preliminary Report on Patentability," The International Bureau of WIPO, Geneva, Switzerland, Jul. 10, 2008.

* cited by examiner

*Primary Examiner*—Bumsuk Won

(57) ABSTRACT

An electroluminescent display device contains an electroluminescent phosphor sandwiched between a pair of electrodes and a graphic arts element. The device is fabricated by bonding a generic electroluminescent base laminate containing an electrode and an electroluminescent layer, to a custom graphic arts film containing a graphic element and a corresponding electrode. The generic electroluminescent base laminate is made at a first location or time, and the custom graphic arts film is made at a second location or time.

8 Claims, 3 Drawing Sheets

METHOD OF MANUFACTURING CUSTOMIZED ELECTROLUMINESCENT DISPLAY

CROSS REFERENCE TO RELATED APPLICATION

This application is related to co-pending application CML03478T, U.S. patent application Ser. No. 11/275,373, entitled "CUSTOMIZED ELECTROLUMINESCENT DISPLAY", filed even date herewith and assigned to Motorola, Inc.

FIELD OF THE INVENTION

This invention relates generally to luminescent displays. More particularly, this invention relates to methods of manufacturing electroluminescent display devices that allow them to be easily customized.

BACKGROUND

Electroluminescent panels, lamps, and displays are light-emitting displays for use in many applications. Electroluminescent (EL) panels are essentially a capacitor structure with an inorganic phosphor sandwiched between two electrodes. The resistance between the two electrodes is almost infinite and thus direct current (DC) will not pass through it. But when an alternating voltage is applied, the build-up of a charge on the two surfaces effectively produces an increasing field (called an electric field) and this causes the phosphor to emit light. The increase in voltage in one direction increases the field and this causes a current to flow. The voltage then decreases and rises in the opposite direction. This also causes a current to flow. The net result is that current flows into the electroluminescent panel and thus energy is delivered to the panel. This energy is converted to visible light by the inorganic phosphor, with little or no heat produced in the process. Application of an alternating current (AC) voltage across the electrodes generates a changing electric field within the phosphor particles, causing them to emit visible light. By making one or both of the electrodes so thin that light is able to pass through and be emitted to the environment, an optically transmissive path is available.

One particular area in which electroluminescent panels can be useful is in lighted advertising displays at the point of product purchase. In today's competitive global environment, local customization of the advertising display is often desirable to accommodate language nuances, local regulations, and cultural mores. However, prior art displays must be fabricated at a dedicated facility, and variations or changes in the display require costly tooling changes and lengthy lead times. This makes local customization very costly and/or impractical. Additionally, small volumes of a single display are also costly, due to the fixed cost of tooling.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention. The drawings are intentionally not drawn to scale in order to better illustrate the invention.

DETAILED DESCRIPTION

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention. The terms a or an, as used herein, are defined as one or more than one. The term plurality, as used herein, is defined as two or more than two. The term another, as used herein, is defined as at least a second or more. The terms including and/or having, as used herein, are defined as comprising (i.e., open language).

Figure 1:
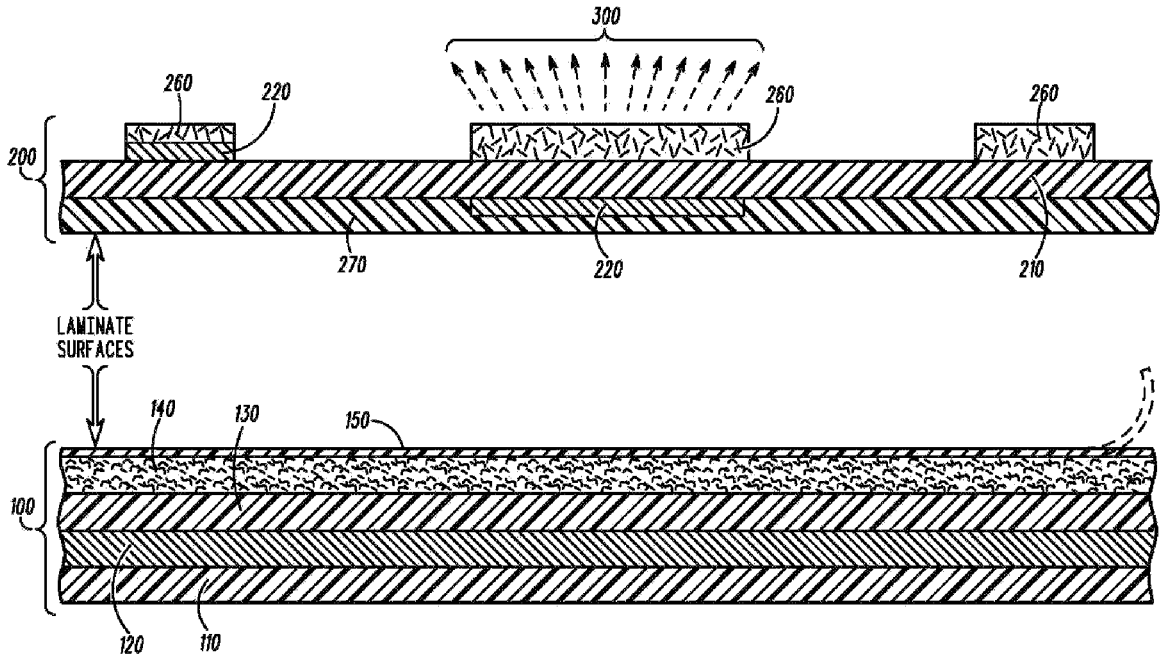
FIG. 1 is a partial cross sectional view of an electroluminescent device in accordance with certain embodiments of the present invention.

An electroluminescent display device is fabricated by bonding a generic electroluminescent base laminate containing an electrode and an electroluminescent layer, to a custom graphic arts film containing a graphic element and a corresponding electrode. The generic electroluminescent base laminate is made at a first location or time, and the custom graphic arts film is made at a second location or time. Referring now to FIG. 1, one embodiment of our invention is formed by providing two (2) separate and distinct laminates. The first generic electroluminescent base laminate 100 consists of a first electrode 120, a dielectric layer 130, and an electroluminescent layer 140, disposed on a flexible substrate 110, such as polyester film (for example, polyethylene terephthalate). The generic base laminate 100 can be fabricated inexpensively, using low cost mass production techniques such as, for example, screen printing, roller coating, curtain coating, reel-to-reel processing, or other techniques familiar to those of ordinary skill in the art, in a dedicated facility. Since patterns are not defined or created on the generic base laminate 100, it can be made in large quantities and in large areas. This base laminate 100 serves as one half of the finished EL display and is made at a first location or time. If desired, a temporary protective layer 150 can be provided on top of the EL layer 140 in order to prevent contaminating or damaging the phosphors in the EL layer. Although FIG. 1 depicts the dielectric layer 130 situated between the EL layer 140 and the first electrode 120, the EL layer can instead be situated between the first electrode and the dielectric layer.

Figure 2:
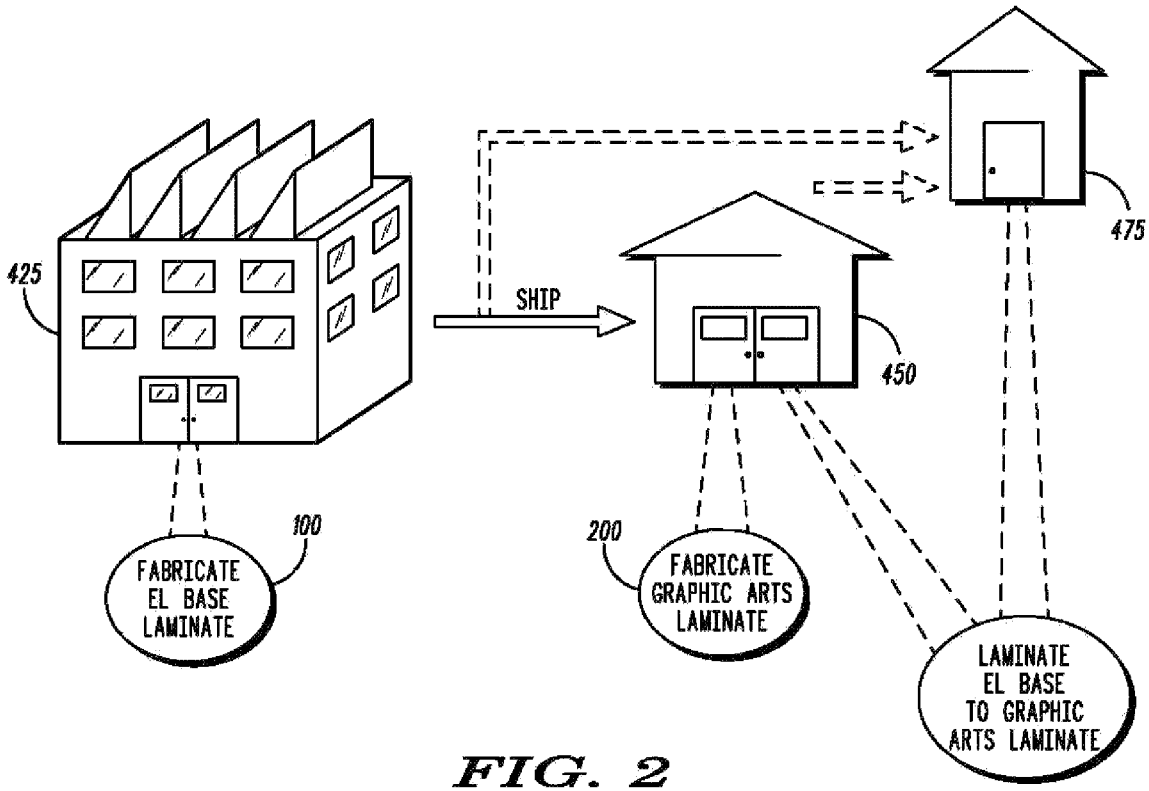
FIG. 2 depicts process flow in accordance with certain embodiments of the present invention.

A graphic arts laminate or graphic arts film 200 contains a second electrode 220 and a graphic element 260 disposed on a second substrate 210. The graphic arts laminate is fabricated at a place or time that is different from that which the generic EL base laminate 100 was produced. The graphic arts laminate 200 is then bonded to the generic EL base laminate 100 to form the customized EL display. The bonding can be achieved by, for example, a clear adhesive 270, or by heat and pressure. Typically, the graphic arts laminate 200 is made "locally" using, for example, commonly available printing techniques e.g. screen, flexo, gravure, litho, etc. Referring now to FIG. 2, the generic EL base laminate 100 might be fabricated in a large electronics factory 425 on one continent, for example, and the graphic arts laminate 200 would be made later in a small printing shop 450 in another country on another continent, and then the two are laminated together at either of the locations 425, 450, or at a third location 475. This allows the graphic arts laminate 200 to be customized to reflect the market conditions and/or cultural requirements that exist at the locale where the display will be used. For example, the generic base laminate for an EL display for a United States company selling a product in Germany could be made in Asia, then shipped to a fabricator in Germany where the custom graphic arts laminate would be made (printing the text in German) and then laminated to the base laminate. This allows a customized EL display to be made quickly and cheaply, eliminating shipping and costly tooling charges.

Figure 3:
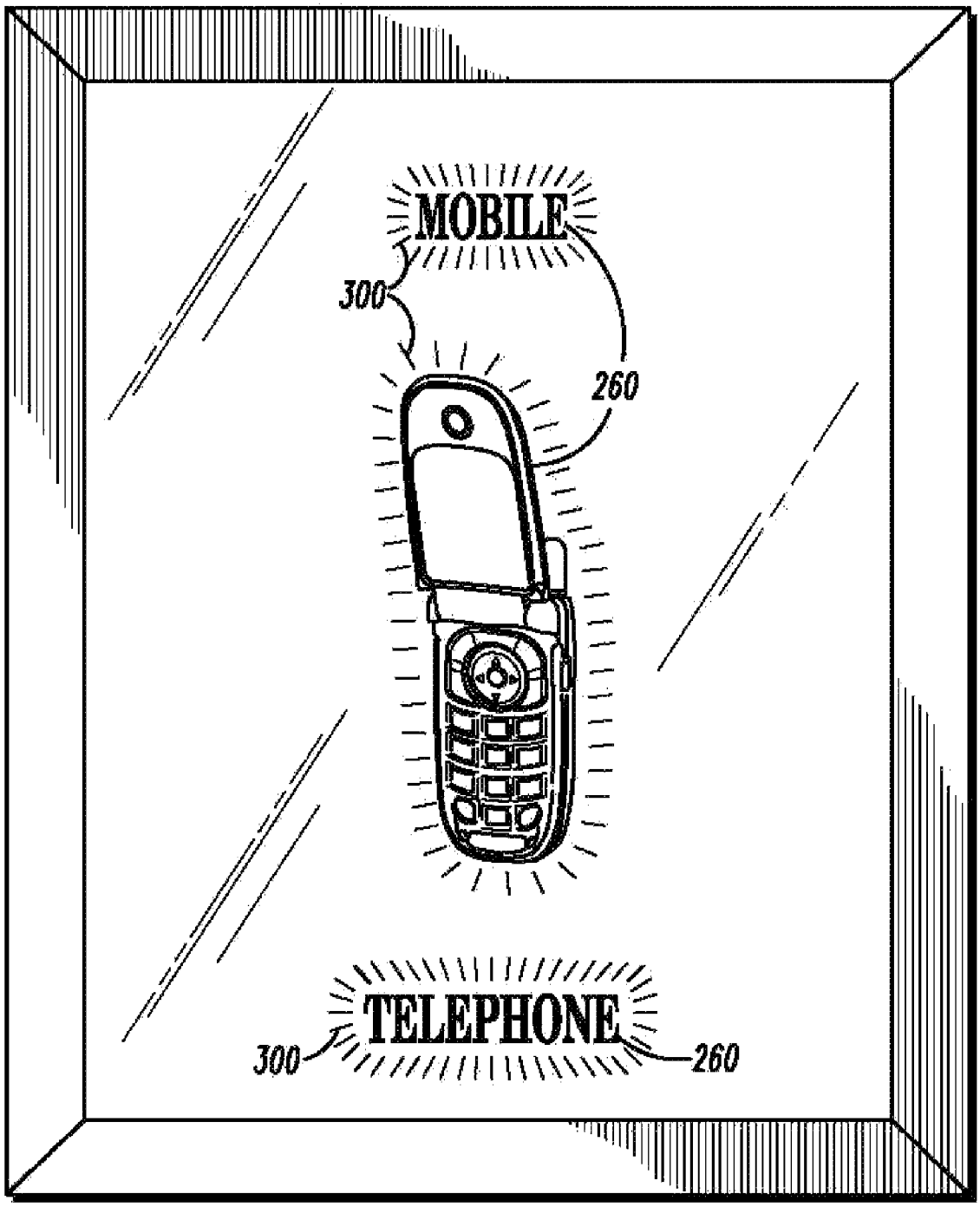
FIG. 3 is an elevational view of an energized electroluminescent display depicting lighted graphic elements in accordance with certain embodiments of the present invention.

In one embodiment, the second electrode 220 is disposed on one side of the second substrate 210 and a graphic element 260 that corresponds to the second electrode is disposed on an opposite side of the second substrate. Subsequently, the graphic arts laminate 200 is bonded to the generic base EL laminate 100 such that the second electrode faces the EL layer 140 on the generic base laminate. Referring now to FIG. 3, the graphic element 260 directly overlies the second electrode, and the second electrode activates only a selected portion of the EL layer that corresponds to the second electrode, so as to light up the portion of the graphic element that is printed directly above the second electrode, as depicted by the arrows 300 representing emitted light. Obviously, the color of both the graphic element and the phosphors in the EL layer will determine the color and intensity of the emitted light 300.

In another configuration, the graphic element 260 does not overlie the second electrode, such that the light emitted by the active portion of the EL layer 140 is not altered by a graphic element.

In still another configuration, the graphic element 260 is disposed directly over the second electrode 220, and both are on the same side of the second substrate 210.

In summary, without intending to limit the scope of the invention, the generic EL base layer has only one electrode and can be manufactured in bulk at low cost with low resolution screen printing techniques. The conductive layer that serves as the second electrode is printed on back surface of the graphic arts substrate using high resolution graphic arts printing well known in the graphic arts field e.g. flexo, gravure, litho, etc. This conductive electrode is patterned to correspond to the lighted area in the graphic arts image. Since the second conductive layer is printed on high resolution presses, the registration is superior to prior art method of creating EL displays. In one embodiment, conductive adhesive can be printed on top of the conductive layer. Non-conductive adhesive covers rest of the back surface on the graphic arts layer.

This novel method of fabricating a custom EL display facilitates significantly lower costs, especially at small volumes, and permits local customization of EL displays. The graphic arts elements can be changed and printed in each local market. This provides a competitive advantage in the highly brand specific, high turnover consumer space.

Having described several embodiments of our invention, it should be obvious that other arrangements of the various layers can be envisioned, yet still fall within the scope and intent of our invention. While the invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations as fall within the scope of the appended claims.

What is claimed is:

1. A method for fabricating an electroluminescent display, the method comprising:

providing a base laminate comprising a first substrate having a first electrode disposed thereon, a dielectric layer disposed on the first electrode, and an electroluminescent layer disposed on the dielectric layer, wherein providing a base laminate comprises providing a base laminate having a removable protective layer overlying the electroluminescent layer;

providing a graphic arts laminate comprising a second substrate having a graphic element disposed on a first side thereof, and having one or more second electrodes disposed on an opposing second side thereof; and removing the protective layer prior to laminating the graphic arts laminate to the base laminate such that the second side of the graphic arts laminate faces the electroluminescent layer.

2. The method as described in claim 1 wherein laminating comprises laminating the second side of the graphic arts laminate to the base laminate by means of an adhesive.

3. The method as described in claim 1 wherein the graphic element is printed to define an image.

4. The method as described in claim 1 further comprising:

laminating at a place or time that is not the same as the place or time at which the electroluminescent base laminate was created.

5. A method for fabricating an electroluminescent display, the method comprising:

providing a base laminate comprising a first substrate having a first electrode disposed thereon, a dielectric layer disposed on the first electrode, and an electroluminescent layer disposed on the dielectric layer, wherein providing a base laminate comprises providing a base laminate having a removable protective layer overlying the electroluminescent layer;

providing a graphic arts laminate comprising a second substrate having one or more second electrodes and one or more graphic elements disposed on a first side thereof and removing the protective layer prior to laminating the graphic arts laminate to the base laminate such that an opposing second side of the graphic arts laminate faces the electroluminescent layer.

6. The method as described in claim 5 wherein laminating comprises laminating the second side of the graphic arts laminate to the base laminate by means of an adhesive.

7. The method as described in claim 5 wherein the graphic element is printed to define an image.

8. The method as described in claim 5 further comprising:

laminating at a place or time that is not the same as the place or time at which the electroluminescent base laminate was created.

* * * * *